US011041274B2

(12) United States Patent
Urmson, Jr. et al.

(10) Patent No.: US 11,041,274 B2
(45) Date of Patent: Jun. 22, 2021

(54) CENTER SUPPORTED BOND JOINT

(71) Applicant: Koppers Delaware, Inc., Wilmington, DE (US)

(72) Inventors: W. Thomas Urmson, Jr., Valencia, PA (US); John W. Mospan, Pittsburgh, PA (US); John M. Downey, Ashland, KY (US); Patrick J. Boario, Allegheny Township, PA (US); Richard Jarosinski, Sarver, PA (US)

(73) Assignee: Koppers Delaware, Inc., Wilmington, DE (US)

( * ) Notice: Subject to any disclaimer, the term of this patent is extended or adjusted under 35 U.S.C. 154(b) by 443 days.

(21) Appl. No.: 15/592,792

(22) Filed: May 11, 2017

(65) Prior Publication Data

US 2018/0119362 A1 May 3, 2018

Related U.S. Application Data

(63) Continuation of application No. 13/473,074, filed on May 16, 2012, now abandoned, which is a continuation of application No. 12/479,301, filed on Jun. 5, 2009, now abandoned, which is a continuation of application No. 11/133,167, filed on May 19, 2005, now abandoned.

(60) Provisional application No. 60/573,117, filed on May 21, 2004.

(51) Int. Cl.
*E01B 11/54* (2006.01)

(52) U.S. Cl.
CPC ..... *E01B 11/54* (2013.01)

(58) Field of Classification Search
CPC ..... E01B 11/00; E01B 11/54; E01B 11/02; E01B 11/08
USPC ..... 238/151, 152, 153, 159, 160, 161, 227, 238/243, 244, 248
See application file for complete search history.

(56) References Cited

U.S. PATENT DOCUMENTS

| | | | |
|---|---|---|---|
| D26,885 | S | 4/1897 | Gardner |
| 1,386,863 | A | 8/1921 | Harrington |
| 1,429,934 | A | 9/1922 | Disbrow |
| 1,429,935 | A | 9/1922 | Disbrow |
| 3,027,092 | A | 3/1962 | Groff |
| 3,100,080 | A | 8/1963 | Fiechter |
| 3,344,990 | A | 10/1967 | Bingmann et al. |
| D217,115 | S | 4/1970 | Chap |
| D225,219 | S | 11/1972 | Dallaire et al. |
| 3,953,015 | A | 4/1976 | Taylor et al. |
| 4,630,772 | A | 12/1986 | Watanabe et al. |
| 5,425,212 | A | 6/1995 | Menchetti |
| 5,503,331 | A | 4/1996 | Urmson, Jr. et al. |
| D375,040 | S | 10/1996 | Miyashita |
| D420,149 | S | 2/2000 | Hersh et al. |
| D428,328 | S | 7/2000 | Jarnagin et al. |
| D491,447 | S | 6/2004 | Diss |
| 7,073,757 | B2 | 7/2006 | Johnson et al. |
| D529,630 | S | 10/2006 | Zarb |
| D543,094 | S | 5/2007 | Remmers |

(Continued)

*Primary Examiner* — Mark T Le
(74) *Attorney, Agent, or Firm* — The Webb Law Firm

(57) ABSTRACT

A center support sleeve for a bonded rail joint bar that includes a body having a head portion, a web portion, and a base portion. The head portion depends from the web portion, which depends from the base portion. The head portion and the base portion are bent in the same direction thereby defining a recess area therebetween. The web portion of the body also defines a plurality of holes.

6 Claims, 6 Drawing Sheets

(56) References Cited

U.S. PATENT DOCUMENTS

| | | | |
|---|---|---|---|
| D547,642 | S | 7/2007 | Urmson, Jr. et al. |
| 2006/0169849 | A1 | 8/2006 | Saavedra |

CENTER SUPPORTED BOND JOINT

CROSS REFERENCE TO RELATED APPLICATIONS

This application is a continuation of U.S. patent application Ser. No. 13/473,074, filed May 16, 2012, which is a continuation of U.S. patent application Ser. No. 12/479,301, filed Jun. 5, 2009, which is a continuation of U.S. patent application Ser. No. 11/133,167 filed on May 19, 2005, which claims the benefit of U.S. Provisional Application No. 60/573,117 filed on May 21, 2004, which applications are hereby incorporated by reference in their entirety.

BACKGROUND OF THE INVENTION

Field of the Invention

The present invention relates to insulated rail joint bars for electrically isolating parts of a rail system from each other and, more particularly, to a center support sleeve for a bonded rail joint bar.

Description of Related Art

A rail system, which permits more than one train to travel on one stretch of track of rail, is generally divided into sections or blocks. The purpose of dividing railroad rails of a rail system into sections is to detect the presence of a train on a section of rail at any given time. Each rail section is electrically isolated from all other sections so that a high electrical resistance can be measured over the rail section when no train is present in that section. When a train enters a rail section, the train will short circuit adjacent railroad rails in which the electrical resistance in the rail section drops, thereby indicating the presence of a train.

Railroad rails are generally welded to each other or attached to each other by a steel joint. Referring to FIG. 1, a typical railroad rail 10 having a first side 12 and a second side 14 includes a body 16 having a head 18, a web 20, and a base 22 having an upper surface 24. The head 18 is connected to the web 20, which is connected to the base 22. A web recess 26 is defined between the head 18 and the base 22 on the first side 12 and the second side 14 of the body 16 of the railroad rail 10.

There are many different types and shapes of rail joint bars. FIG. 1 shows a typical prior art rail joint bar 30 that can be used to attach railroad rails to each other. The prior art rail joint bar 30 generally includes a body 32 having a front surface 34 and a back surface 36 and defining a head section 38, a web section 40 and a base section 44. The head section 38 depends from the web section 40, which depends from the base section 44. The web section 40 defines a plurality of holes 42 for receiving fasteners (one hole 42 shown in FIG. 9). The base section 44 having a bottom surface 46 extends away from the front surface 34 of the body 32 of the rail joint bar 30. The prior art rail joint bar 30 is adapted to be received within the web recess 26 of the railroad rail 10, wherein the bottom surface 46 of the body 32 of the rail joint bar 30 is adjacent the upper surface 24 of the base 22 of the railroad rail 10.

High-performance, non-metallic rail joint bars are typically used for electrically-isolating adjacent rail sections of a rail system in order to create an electrically-isolated section. However, these non-metallic rail joint bars are very expensive because of the special high-performance material needed to endure the high tensile and flexural forces exerted on a rail joint bar as the wheels of a locomotive or rail car pass over the rail joint bar. These tensile and flexural forces are higher at a center portion of the rail joint bar where the two railroad rails are joined. An alternative to the non-metallic rail joint bar is a steel rail joint bar having electrically-insulating adhesive material A, such as epoxy, bonded to the back surface 36 of the rail joint bar 30 (shown in FIG. 1). However, these epoxies will oftentimes peel off of the bonded rail joint bar 30, particularly at the center where the tensile and flexural forces are the highest, thereby resulting in a weaker bonded rail joint bar 30 with less electrical insulating capability. It is, therefore, desirable to have a support sleeve positioned between a bonded rail joint bar and where two railroad rails are joined in order to spread the impact loads of the rail cars away from the center portion of the rail joint bar, thus preventing damage to the bonded rail joint bar at this center location.

SUMMARY OF THE INVENTION

The present invention provides for a center support sleeve for a bonded rail joint bar that includes a body having a head portion, a web portion, and a base portion. The head portion depends from the web portion, which depends from the base portion. The head portion and the base portion are bent in the same direction thereby defining a recess area therebetween. The web portion of the body also defines a plurality of holes or slots.

The present invention also provides for a railroad rail assembly that includes two abutting railroad rails and a prior art rail joint bar attached to the abutting railroad rails. An adhesive is sandwiched between a back surface of the rail joint bar and the two abutting railroad rails. A center support sleeve as previously described is sandwiched between a center portion of the back surface of the rail joint bar and the two abutting railroad rails, wherein the support sleeve is adapted to spread the impact loads of rail cars away from the center portion of the rail joint bar.

The present invention provides for a method for securing two abutting railroad rails that includes the steps of joining two railroad rails end to end and positioning an electrically-insulating spacer between the ends of the two railroad rails positioned end to end. Next, an adhesive is placed on a surface of a rail joint bar and a center support sleeve is positioned on a center portion of the surface of the rail joint bar. Finally, the rail joint bar having the adhesive and the support sleeve is attached to the railroad rails via a fastener, wherein the support sleeve is sandwiched between the railroad rails and the rail joint bar.

DETAILED DESCRIPTION OF THE INVENTION

Figure 2:
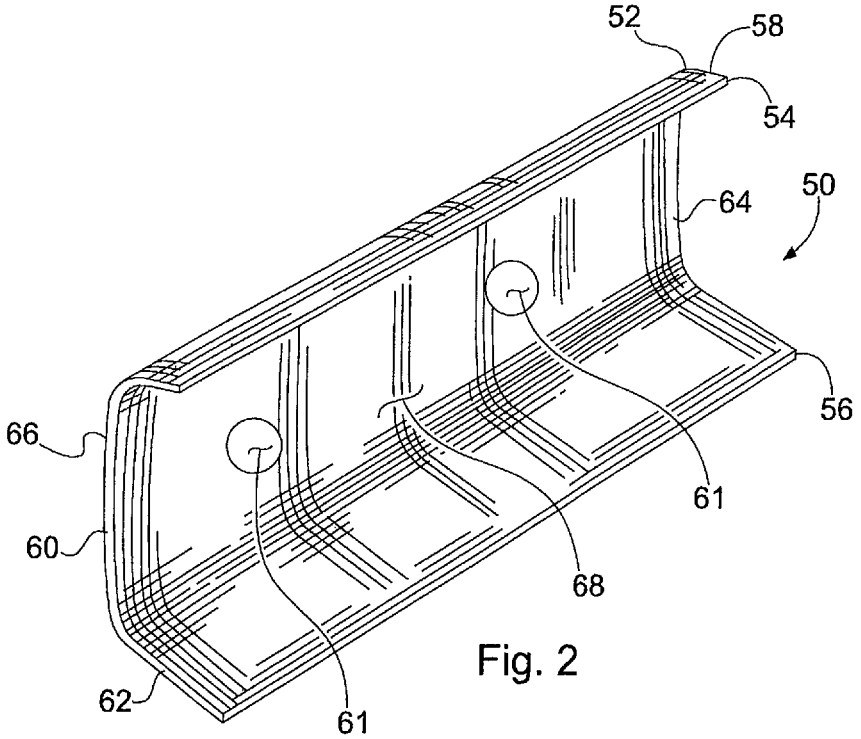
FIG. 2 is a perspective view of a center support sleeve made in accordance with the present invention.
Figure 2A:
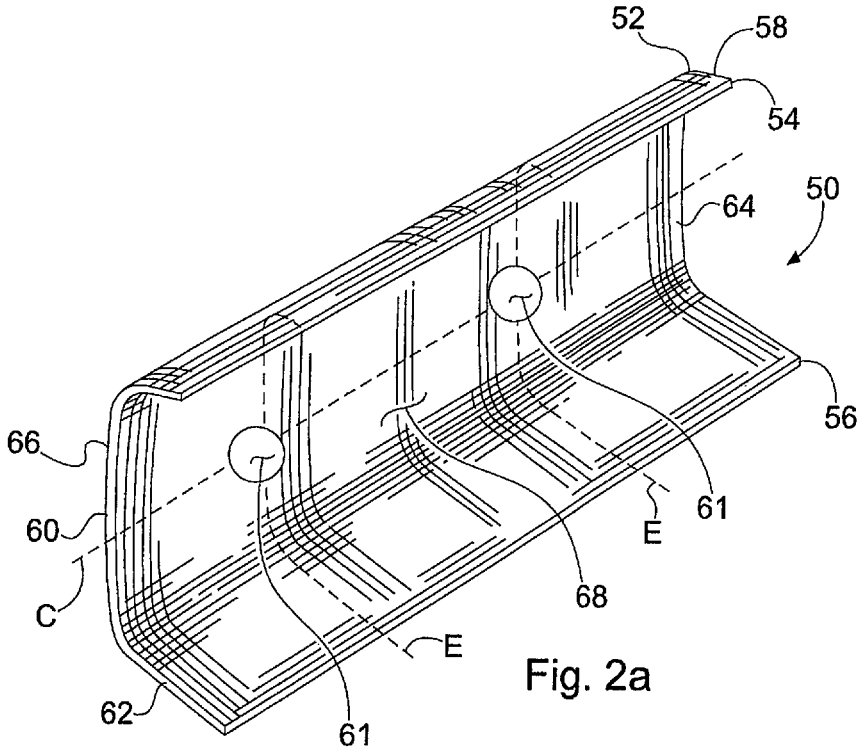
FIG. 2*a* is a perspective view of other embodiments identified by dashed lines of the center support sleeve shown in FIG. 2.
Figure 3:
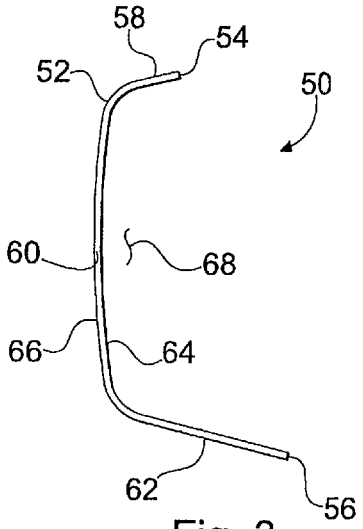
FIG. 3 is an elevational side view of the sleeve shown in FIG. 2.
Figure 4:
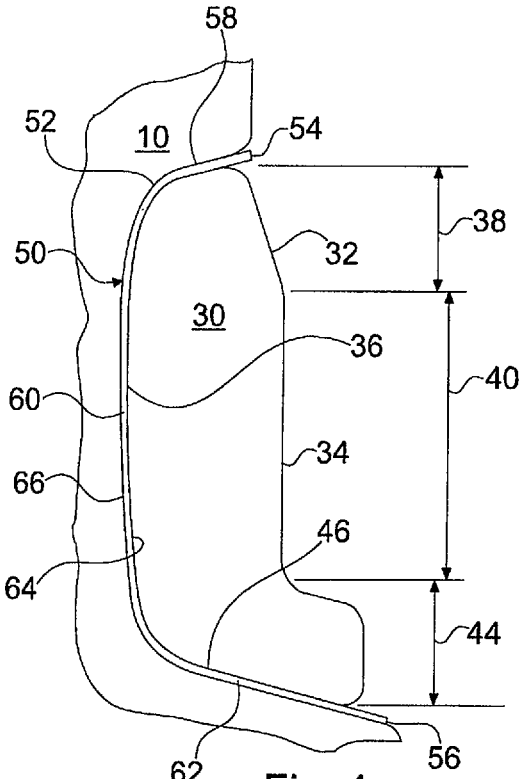
FIG. 4 is an elevational side view of the center support sleeve shown in FIG. 2 attached to a prior art rail joint bar.
Figure 8:
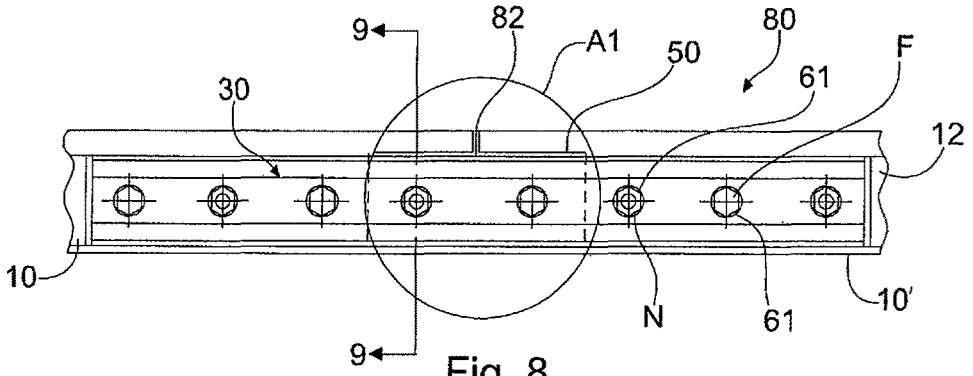
FIG. 8 is an elevational side view of a rail joint assembly made in accordance with the present invention.

Referring to FIGS. 2-4, the present invention provides a center support sleeve 50 that is adapted to be sandwiched between a center portion of a prior art rail joint bar 30 and a pair of railroad rails 10, 10' (designated as area A1 shown in FIG. 8). The support sleeve 50 extends partially around the rail joint bar 30 as shown in FIG. 4 in order to spread the impact loads of the rail cars away from the center portion of the rail joint bar 30. The sleeve 50, which has an end profile similar to the back surface 36 of the prior art rail joint bar 30 includes a body 52 having a first end 54 and a second end 56 and defining a head portion 58, a web portion 60, and a base portion 62. The body 52 of the sleeve 50 includes a first surface 64 and a second surface 66, wherein the head portion 58 depends from the web portion 60, which depends from the base portion 62. The head portion 58 and the base portion 62 are bent in a direction toward the first surface 64 of the web portion 60, thus defining a U-shaped recess area 68 therebetween. The web portion 60 also defines a plurality of holes 61 (shown in FIG. 2) for receiving fasteners. Alternatively, the length of the sleeve 50 may be shortened by removing the sleeve 50 at dashed lines E, thereby removing end portions such that an open-ended hole or slot 61 may be provided therein (shown in FIG. 2*a*). As used herein, "holes" means holes and/or open-ended slots. Referring to FIG. 2*a*, the base portion 62 and a portion of the web portion 60 may also be removed from sleeve 50 (at dashed line C), thereby providing a sleeve with only a head portion 58 and a partial web portion 60. Further, both the end portions (dashed lines E) and a portion of the web portion 60 (dashed line C) may be removed from sleeve 50, thereby providing a shortened sleeve having a partial web portion 60.

The sleeve 50 can be made of an electrically-insulating material, such as fiberglass or a polymeric material such as polyurethane. Referring to FIG. 8, a sleeve 50 made of fiberglass is preferably used to prevent damage to a center portion of the rail joint bar 30, by spreading the impact loads of rail cars away from area A1 of the rail joint bar 30 where the tensile and flexural forces are the greatest. For example, a fiberglass sleeve 50 (e.g., having multiple plies, for example, five plies where adjacent plies strands are arranged transverse to each other) can generally support a load of at least 100,000 psi tensile strength and have a compression strength of at least 70,000 psi. In contrast to a sleeve 50 made of fiberglass, a sleeve 50 made of polyurethane provides a dampening effect in area A1, thereby preventing damage to the center portion of the rail joint bar 30 by allowing for greater flexibility in area A1 of the railroad rails 10, 10' than in the areas adjacent A1 (i.e., lateral portions of rail joint bar 30). For example, a polyurethane sleeve 50 having a thickness of about 0.060 inches can generally support a load of at least 6500 psi tensile strength and at least 270 percent elasticity. The thickness and the length of the sleeve 50 can vary, however, the length of the sleeve 50 should be long enough, wherein at least two of the center portion holes 42 of the rail joint bar 30 align with the holes 61 in the sleeve 50.

Figure 5:
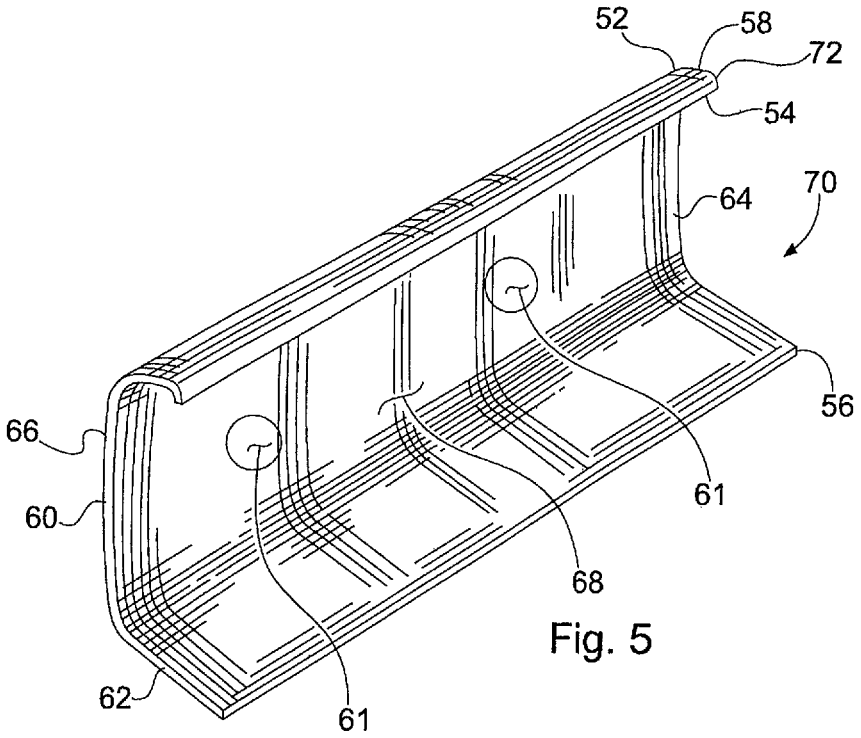
FIG. 5 is a perspective view of a center support sleeve made in accordance with a second embodiment of the present invention.
Figure 5A:
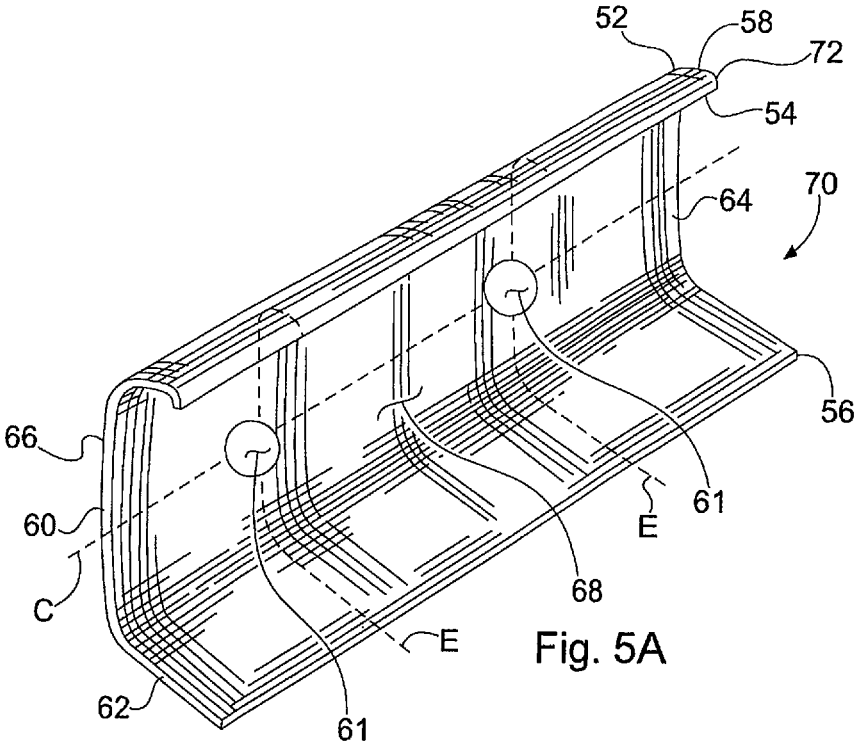
FIG. 5*a* is a perspective view of other embodiments identified by dashed lines of the center support sleeve shown in FIG. 5.
Figure 6:
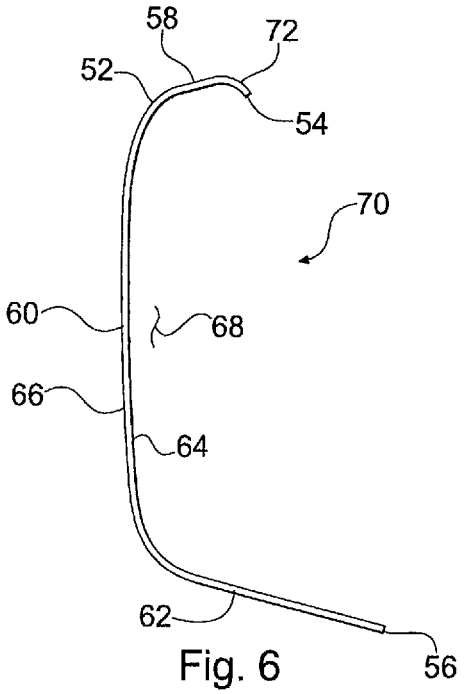
FIG. 6 is an elevational side view of the sleeve shown in FIG. 5.
Figure 7:
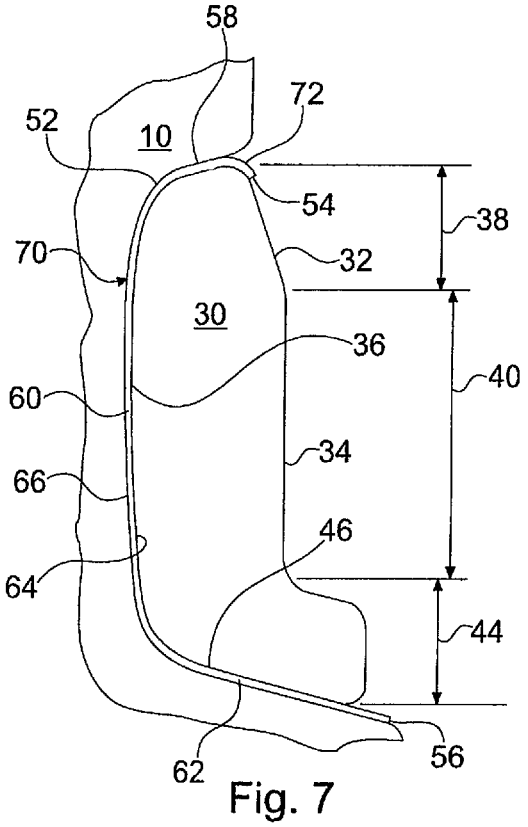
FIG. 7 is an elevational side view of the center support sleeve shown in FIG. 5 attached to a prior art rail joint bar.

FIGS. 5-7 show another embodiment of a center support sleeve 70 that is similar to sleeve 50, except for the differences noted below. Like reference numerals are used for like parts. The first end 54 of the head portion 58 is bent toward the base portion 62 thus forming an arcuate-shaped lip 72 adapted to fit the contour of the head section 38 of the body 32 of the prior art rail joint bar 30 as shown in FIG. 7. FIG. 5*a* also shows other embodiments as represented by dashed lines C, E and C and E, of sleeve 70 similar to the embodiments of sleeve 50 shown in FIG. 2*a*.

Figure 1:
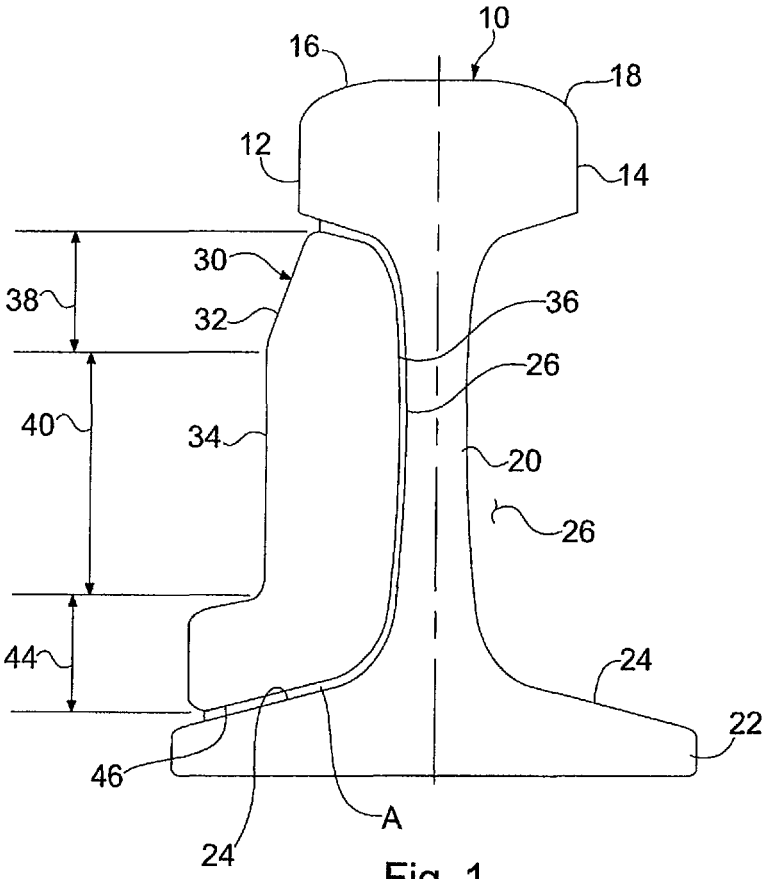
Fig. 1 (Prior Art)
FIG. 1 is a side elevational view of a typical prior art rail joint bar co-acting with a railroad rail.

When two abutting railroad rails 10, 10' are joined together using a prior art rail joint bar 30 as shown in FIG. 8, a rail bonding adhesive A (shown in FIG. 1), such as an epoxy, is typically interposed between the rail joint bar 30 and the railroad rails 10, 10', thereby providing for a stronger and more durable electrically-insulated bond joint. These epoxies, which can be any of the types well known in the art, generally have a shear strength in a range of 3,000 to 4,000 psi and an elasticity ranging from 0.001 to 0.003 inch per inch elasticity. However, because of the high tensile and flexural forces exerted on the railroad rails 10, 10', particular at area A1 (shown in FIG. 8) where the two railroad rails 10, 10' are joined, these epoxies will oftentimes peel off of the rail joint bar 30, resulting in a weaker bonded rail joint bar 30 and less electrical insulating capability. The sleeve 50, when used in combination with the rail joint bar 30, may eliminate the need for an epoxy in area A1, thus eliminating any potential unzipping of the epoxy from the rail joint bar 30.

Figure 9:
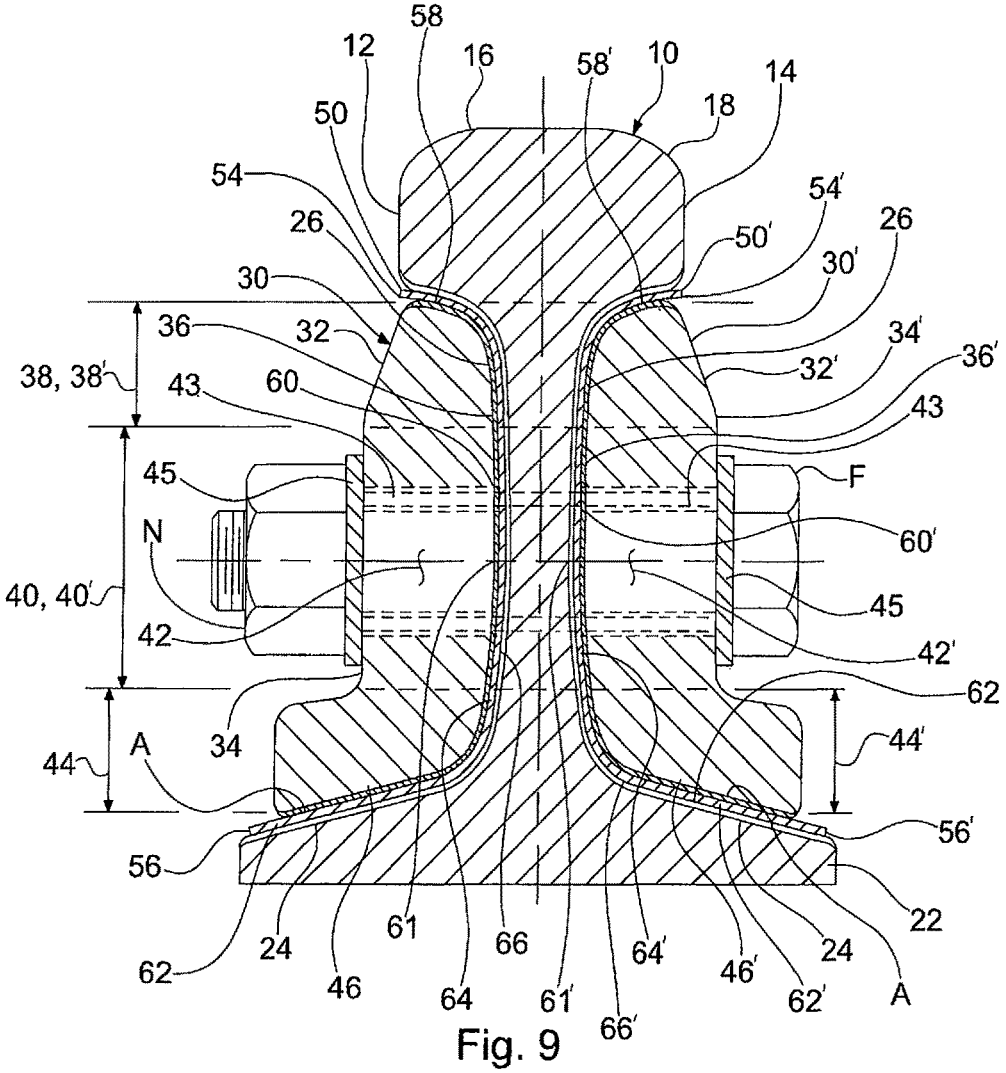
FIG. 9 is a sectional view of the rail joint assembly taken along lines IX-IX shown in FIG. 8.

Referring to FIGS. 8 and 9, the present invention provides for a rail joint assembly 80 that includes a first railroad rail 10 joined to a second railroad rail 10' and having a spacer 82 therebetween. The rail joint assembly 80 further includes two prior art rail joint bars 30, 30', wherein rail joint bar 30 is fastened to a first side 12 of the railroad rails 10, 10', and rail joint bar 30', which is identical to rail joint bar 30, is fastened to a second side 14 of the railroad rails 10, 10' as shown in FIG. 9. A sleeve 50, as previously described, is sandwiched in area A1 between the first side 12 of railroad rails 10, 10' and rail joint bar 30, and a second sleeve 50', which is identical to sleeve 50, is sandwiched in area A1 between the second side 14 of railroad rails 10, 10' and rail joint bar 30'. The sleeves 50, 50' are positioned intermediate of the ends of the rail joint bars 30, 30' (i.e., in area A1). The holes 42 in rail joint bar 30 and the holes 61 in sleeve 50 are aligned with the corresponding holes 42' in rail joint bar 30' and the holes 61' in sleeve 50'. A fastener F, such as a bolt, then passes through each corresponding hole 42, 42' of rail joint bars 30, 30', each corresponding hole 61, 61' of sleeves 50, 50', and the respective railroad rail 10, 10'. A nut N can then be threaded or welded at an end of the fastener F. A rail bonding adhesive A made of electrically-insulating material, such as an epoxy, can be dispersed across either the entire back surface 36, 36' or only on the lateral portions of the back surface 36, 36' of the rail joint bars 30, 30', respectively, in order to hold the sleeves 50, 50' in place, thus preventing movement of the rail ends due to temperature changes. Also, an adhesive such as an epoxy, silicon or rubber cement, or seal (not shown) can be placed between the sleeves 50, 50' and the railroad rails 10, 10', respectively, and/or the rail joint bars 30, 30' and the sleeves 50, 50' in order to prevent shortening of the sleeves 50, 50' due to moisture. In the area adjacent area A1, the rail joint bars 30, 30' may be attached to the railroad rail 10, 10' using fiberglass beaded plates such as described in U.S. Pat. No. 5,503,331, which is hereby incorporated by reference in its entirety.

The surfaces defining the holes 42, 42' in rail joint bars 30, 30' can be at least partially surrounded by an electrically insulated bushing 43 (shown in phantom in FIG. 9) to prevent the fasteners F from conducting electric current between the railroad rails 10, 10' and the rail joint bars 30, 30', thereby assuring electrical insulation of the rail joint assembly 80. Likewise, washers 45, when used in conjunction with fasteners F, may also be made of an electrically insulating material. Also, in lieu of the two bushings 43, a single bushing (not shown) can also be used.

The present invention provides for a method of securing two abutting railroad rails 10, 10' using prior art rail joint bars 30, 30', wherein the abutting railroad rails 10, 10' are electrically isolated from one another. First, an end of the first railroad rail 10 is joined to an end of the second railroad rail 10' and an electrically-insulating spacer 82 is positioned therebetween as shown in FIG. 8. Second, a rail bonding adhesive A, such as an epoxy, may be dispersed across the back surface 36, 36' of the rail joint bars 30, 30' or only on the lateral portions of the back surface 36, 36' of the rail joint bars 30, 30', respectively. Third, a first sleeve 50 is positioned on a center portion of the back surface 36 of rail joint bar 30, and a second sleeve 50' is positioned on a center portion of the back surface 36' of rail joint bar 30', wherein the holes 61, 61' in sleeves 50, 50' are aligned with the holes 42, 42' in rail joint bars 30, 30', respectively. Fourth, rail joint bar 30 having the sleeve 50 is placed on a first side 12 within the web recess 26, and rail joint bar 30' having the sleeve 50' is placed on a second side 14 within the web recess 26 at the center location (area A1) of the railroad rails 10, 10'. Next, the rail joint bars 30, 30' are attached to the railroad rails 10, 10' via fasteners F passing through each corresponding hole 42, 42' of rail joint bars 30, 30', each corresponding hole 61, 61' of sleeves 50, 50' and the respective railroad rail 10, 10'. A nut N can be placed at an end of the fasteners F and tightened. When the sleeves 50, 50' are made of polyurethane, it is desirable that the fasteners F be tightened further before the adhesive material A on the rail joint bars 30, 30' completely cures after being applied. An adhesive such as epoxy, silicon, or rubber cement (not shown) can also be placed on the first surface 64, 64' and the second surface 66, 66' of the sleeves 50, 50', respectively, before attachment of the rail joint bars 30, 30' to the first side 12 and the second side 14 of the railroad rails 10, 10', respectively.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A rail joint assembly, comprising:

first and second railroad rails having abutting ends;

a rail joint bar attached to the abutting railroad rails, the rail joint bar including a body having a front surface and a back surface and defining a head section, a web section depending from the head section, and a base section depending from the web section; the web section having a plurality of holes defined in the body, wherein the holes are adapted to receive fasteners for securing a rail joint bar to two abutting railroad rails;

a center support sleeve made of an electrically-insulating material sandwiched between a center portion of the back surface of the body of the rail joint bar and the two abutting railroad rails, the support sleeve positioned intermediate of ends of the rail joint bar and extending across the abutting ends of the first and second railroad rails, wherein the support sleeve is adapted to spread impact loads of rail cars away from a center portion of the rail joint bar;

shapeable fiberglass mattings positioned between the back surface of the body of the rail joint bar and the first and second railroad rails at lateral portions of the rail joint bar and adjacent to the center support sleeve;

a first layer of adhesive positioned between the center support sleeve and the first and second railroad rails and between the shapeable fiberglass mattings and the first and second railroad rails; and a second layer of adhesive positioned between the center support sleeve and the rail joint bar and between the shapeable fiberglass mattings and the rail joint bar.

2. The rail joint assembly of claim 1, wherein the center support sleeve comprises a body having a head portion, a web portion, and a base portion, the head portion depends from the web portion which depends from the base portion, wherein the head portion and the base portion define a recess area between the head portion and the base portion, and wherein the web portion of the body defines a plurality of holes adapted to receive fasteners.

3. The rail joint assembly of claim 2, comprising a plurality of fasteners passing through the holes in the rail joint bar and the holes in the sleeve for securing the rail joint bar to the two abutting railroad rails.

4. The rail joint assembly of claim 2, wherein the sleeve is capable of supporting a load of at least 100,000 psi tensile strength and have a compression strength of at least 70,000 psi.

5. The rail joint assembly of claim 1, wherein the first and second layers of adhesive comprise an epoxy that is capable of creating a bond of at least 3000 psi shear strength and at least 0.001 inch per inch elasticity.

6. The rail joint assembly of claim 1, wherein the center support sleeve comprises a body having a head portion and a web portion depending from said head portion.

* * * * *